US006161710A

United States Patent [19]

Dieringer et al.

[11] Patent Number: 6,161,710

[45] **Date of Patent: *Dec. 19, 2000**

[54] NATURAL NIPPLE BABY FEEDING APPARATUS

[76] Inventors: Mary F. Dieringer, 9315 SE. Regents Dr., Milwaukie, Oreg. 97222; Fernando Suarez, 1402 Morgan Cir., Tustin, Calif. 92780

[ * ] Notice: This patent issued on a continued prosecution application filed under 37 CFR 1.53(d), and is subject to the twenty year patent term provisions of 35 U.S.C. 154(a)(2).

[21] Appl. No.: 09/181,950

[22] Filed: Oct. 28, 1998

Related U.S. Application Data

[60] Provisional application No. 60/064,094, Nov. 3, 1997, and provisional application No. 60/090,114, Jun. 22, 1998.

[51] Int. Cl.[7] ..... A61J 9/00

[52] U.S. Cl. ..... 215/11.4; 606/236

[58] Field of Search ..... 215/11.3, 11.4, 215/11.5, 11.1; 606/236

[56] References Cited

U.S. PATENT DOCUMENTS

D. 288,241 2/1987 Fuller .
D. 360,468 7/1995 Fuller .

(List continued on next page.)

OTHER PUBLICATIONS

White River Concepts, Breastfeeding Success Products Brochure, 800–342–3906, http://www.whiteriver.com.

Avent America Inc., Avent Naturally Brochure, 1997, 501 Lively Blvd., Elk Grove Village, IL 60007.

Nuk, Nuk Nipples for Every Bottle Every Baby Advertisement, p. 63.

Gerber, Gerber advertisement, p. 13.

Playtex Products Inc., Playtex Advance Advertisement, 1998.

Playtex Products Inc., The Playtex Nurser System Advertisement, 1997.

Evenflo Company Inc., Evenflo Baby Products, May 1997, Evenflo Company Inc, Piqua, OH 45356.

Johnson & Johnson, Health Flow Bottle Advertisement, 1997, Lamaze Parents' Magazine, p. 17.

Medicine Bottle Co., Rx Medibottle Advertisement, 1997/1998, Fit Pregnancy Buyer's Guide, p. 94.

*Primary Examiner*—Allan N. Shoap
*Assistant Examiner*—Tri M. Mai
*Attorney, Agent, or Firm*—Ingrid McTaggart

[57] ABSTRACT

An improved natural nipple baby feeding apparatus includes detachable inner and outer membranes which both extend substantially across a distance larger than the diameter of a standard baby bottle to which the nipple apparatus may be attached. The membranes have a width approximately double that of the height of the nipple apparatus. The apparatus functions as a training device for an infant by requiring the infant to correctly "latch-on" to the apparatus by grasping the apparatus outwardly of the central nipple area and stretching the outer membrane upwardly so that it contacts the inner membrane which facilitates the flow of fluid from the bottle through both the membranes and out of the nipple. The nipple apparatus may be used in conjunction with, or as an alternative to, breast-feeding of an infant.

13 Claims, 8 Drawing Sheets

U.S. PATENT DOCUMENTS

| | | | |
|---|---|---|---|
| 954,564 | 4/1910 | Dunfee | 215/11.5 |
| 1,360,893 | 11/1920 | Cowie | 215/11.3 |
| 2,584,359 | 2/1952 | Miles | 215/11.3 |
| 2,661,001 | 12/1953 | Alstadt et al. | 215/11.4 |
| 2,803,251 | 8/1957 | White | 215/11.5 |
| 3,424,157 | 1/1969 | Paolo . | |
| 3,532,242 | 10/1970 | Tibbs . | |
| 4,586,621 | 5/1986 | Daham | 215/11.3 |
| 4,623,069 | 11/1986 | White . | |
| 4,685,577 | 8/1987 | Chen | 215/11.5 |
| 4,723,668 | 2/1988 | Cheng . | |
| 4,726,376 | 2/1988 | Dahan . | |
| 4,917,252 | 4/1990 | Chambers . | |
| 4,993,568 | 2/1991 | Morifuji . | |
| 5,020,679 | 6/1991 | Signorini . | |
| 5,035,340 | 7/1991 | Timmons . | |
| 5,072,842 | 12/1991 | White . | |
| 5,101,991 | 4/1992 | Morifuji et al. | 215/11.1 |
| 5,108,686 | 4/1992 | Griffin . | |
| 5,295,597 | 3/1994 | Green | 215/11.4 |
| 5,431,290 | 7/1995 | Vinciguerra | 215/11.5 |
| 5,544,766 | 8/1996 | Dunn et al. . | |
| 5,553,726 | 9/1996 | Park . | |
| 5,653,732 | 8/1997 | Sheehy . | |
| 5,673,806 | 10/1997 | Busnel . | |
| 5,690,679 | 11/1997 | Prentiss . | |
| 5,747,083 | 5/1998 | Raymond et al. | 215/11.4 |
| 5,791,503 | 8/1998 | Lyons | 215/11.5 |

NATURAL NIPPLE BABY FEEDING APPARATUS

This application claims benefit of Provisional Application Ser. No. 60/064,094 filed Nov. 3, 1997, and Provisional Application Ser. No. 60/090,114 filed Jun. 22, 1995.

TECHNICAL FIELD

The present invention relates to an improved natural nipple baby feeding apparatus, and more particularly, to an improved natural nipple baby feeding apparatus having detachable inner and outer membranes which both extend substantially across a distance larger than the diameter of a standard baby bottle to which the nipple apparatus may be attached and having a width approximately double that of the height of the nipple apparatus. The apparatus functions as a training device for an infant by requiring the infant to correctly "latch on" to the apparatus. Specifically, the device trains an infant to grasp the apparatus outwardly of the central nipple area and then to pull the central nipple area of the outer membrane so that it becomes taunt. The taut, stretched outer membrane pinches the inner membrane so as to open a valve in the inner membrane which facilitates the flow of fluid from the bottle through the nipple. The nipple apparatus may be used in conjunction with, or as an alternative to, natural breast-feeding of an infant. Accordingly, the apparatus of the present invention may be used to extend the period of time during which a child may be breast-fed.

BACKGROUND ART

Breast-feeding of newborns and infants has many important medical benefits including enhanced nutrition and immunity to certain illnesses. A mother's breast milk changes with the needs of a growing infant so as to satisfy these health needs of the infant through several development stages. Human breast milk includes immunoglobulins that increase a baby's resistance to many bacteria and viruses. Breast milk is said to inhibit the development of allergies and is rich in protein, sugars, fats, vitamins, and minerals. Recent research suggests that a breast-fed child may have a smaller incidence of ear infections and diarrhea than a non breast-fed child. Moreover, breast-feeding can be very convenient because bottles need not be prepared, transported or cleaned. Breast-feeding also has economic benefits because expensive formulas and bottles need not be purchased.

During breast-feeding an infant "latches on" by taking the entire areola of the breast, or at least a large portion thereof, in their mouth and beginning to suck. The infant's jaws should close around the areola, and not around the central teat or nipple area, which my result in soreness, bleeding and blistering of the nursing mother. By taking a large portion of the areola in their mouth, the infant's gums will form a circular seal and a vacuum on the central nipple area. The infant then stretches and presses the nipple against their palate and squeezes the milk ducts in a rhythmic motion. This releases milk from the lactiferous glands to the milk ducts and ultimately out of several fine holes in the tip of the nipple. Accordingly, some work is required of the infant to receive nourishment during breast-feeding.

Proper breast-feeding, i.e., having the infant "latch on" correctly, may require an extensive amount of training time in which the mother and infant work together to perfect the technique. This learning process is made more difficult when the newborn has been given a bottle or a pacifier. These devices can cause the infant to lick, nibble or chew with their jaws instead of using their tongue to stretch the nipple and apply suction pressure. When proper breast-feeding is achieved, mothers may worry that their baby will forget the proper technique once the baby tries a bottle. Accordingly, due to the benefits of natural breast milk, and due to these training concerns, breast-feeding mothers may be hesitant to allow their infant to try bottle-feeding.

Despite the many benefits of breast-feeding an infant and the many concerns of the mother that their infant may forget the proper breast-feeding technique, many breast-feeding mothers must return to work or otherwise be away from their infant for extended periods of time. In these situations, exclusive breast-feeding is not possible and supplementation with a bottle is needed. Moreover, nursing mothers often must breast-feed their child every two hours for thirty to forty minutes at a time. This can be physically exhausting for the mother. Accordingly, many mothers try to use baby bottles in conjunction with breast-feeding, or switch to bottle feeding altogether. In either case, the infant often will encounter problems during the transition to exclusive bottle-feeding, or with the transition to and from breast-feeding and bottle-feeding when both methods are utilized. When presented with a bottle the infant may refuse to use the bottle because it feels very different from their mother. Use of prior art bottles generally does not ease this transition. Accordingly, even though many women would like to breast feed their infant for several months or even a year, once the infant is introduced to a bottle at several months of age, the infant often will refuse to return to breast-feeding.

Prior art bottles and nipples do not look or feel like a natural breast. These nipples typically comprise an elongate, smooth single rubber nipple piece that has a width much narrower than a natural breast. These prior art nipples allow the infant to apply only suction pressure to the nipple tip to begin fluid flow from the bottle. Moreover, these nipples permit the flow of fluid from the bottle without mechanical pressure applied by the infant. In either case, the fluid is more easily obtained by the infant than during natural breast-feeding wherein the infant must grasp the entire areola in their mouth and simultaneously apply mechanical and suction pressure to the nipple. Accordingly, once the infant is comfortable with bottle feeding the infant will often encounter "nipple confusion" upon returning to breast-feeding.

"Nipple confusion" can be physically painful for the nursing mother because the infant may attempt to breast-feed by grasping only the tip portion of the nipple and therefore not grasping the entire areola in their mouth. In addition, "nipple confusion" can result in frustration to the infant because they may grow accustomed to receiving nourishment without being required to simultaneously apply mechanical and suction pressure to stretch the nipple. The difference between a natural breast and prior art nipples may lead infants to refuse to return to breast-feeding altogether. This may be psychologically and emotionally difficult for a nursing mother that is rejected by her infant who now prefers the "easy" method of bottle-feeding.

Other prior art nipples may include a single rubber piece having a valve positioned therein for preventing the spillage of fluid from the bottle if overturned. These valved prior art nipples present a sanitation problem, however, due to the difficulty of cleaning the inner cavities of the nipple. Moreover, the elongate outer shape of these valved prior art nipples presents the same "nipple confusion" issues as the non-valved prior art elongate nipples.

DISCLOSURE OF THE INVENTION

Accordingly, an object of the present invention is to provide a natural nipple baby feeding apparatus that simulates natural breast-feeding.

Another object of the present invention is to provide a natural nipple baby feeding apparatus that is manufactured from a mold of an actual woman's breast.

Yet another object of the present invention is to provide a natural nipple baby feeding apparatus that eases the transition to and from bottle feeding and natural breast-feeding.

A further object of the present invention is to provide a natural nipple baby feeding apparatus that functions as a training device for an infant by requiring the infant to correctly "latch on" to the apparatus to receive nourishment.

Yet another object of the present invention is to provide a natural nipple baby feeding apparatus that includes detachable inner and outer membranes which both extend substantially across the diameter of a baby bottle to which the nipple apparatus is attached to facilitate cleaning of the membranes.

Still another object of the present invention is to provide a natural nipple baby feeding apparatus that has a width approximately double that of the height of the nipple apparatus.

Accordingly, the nipple apparatus of the present invention includes detachable inner and outer membranes which both extend substantially across a distance greater than the diameter of a standard baby bottle to which the nipple apparatus is attached, and wherein the nipple apparatus has a width approximately double that of its height. Due to the double membrane system the apparatus is easy to clean. The nipple apparatus, in the preferred embodiment, is manufactured from a mold of an actual woman's breast. Due to the double membrane system, the apparatus functions as a training device for an infant by requiring the infant to correctly "latch on" to the apparatus. Specifically, the device trains an infant to grasp the apparatus outwardly of the central nipple area and then to pull the central nipple area of the outer membrane so that it becomes taunt. The taunt, stretched outer membrane pinches the inner membrane so as open a valve in the inner membrane which facilitates the flow of fluid from the bottle through the nipple. Accordingly, the "latching on" technique required by the nipple apparatus of the present invention is virtually identical to that required during natural breast feeding.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BEST MODES FOR CARRYING OUT THE INVENTION

Figure 1:
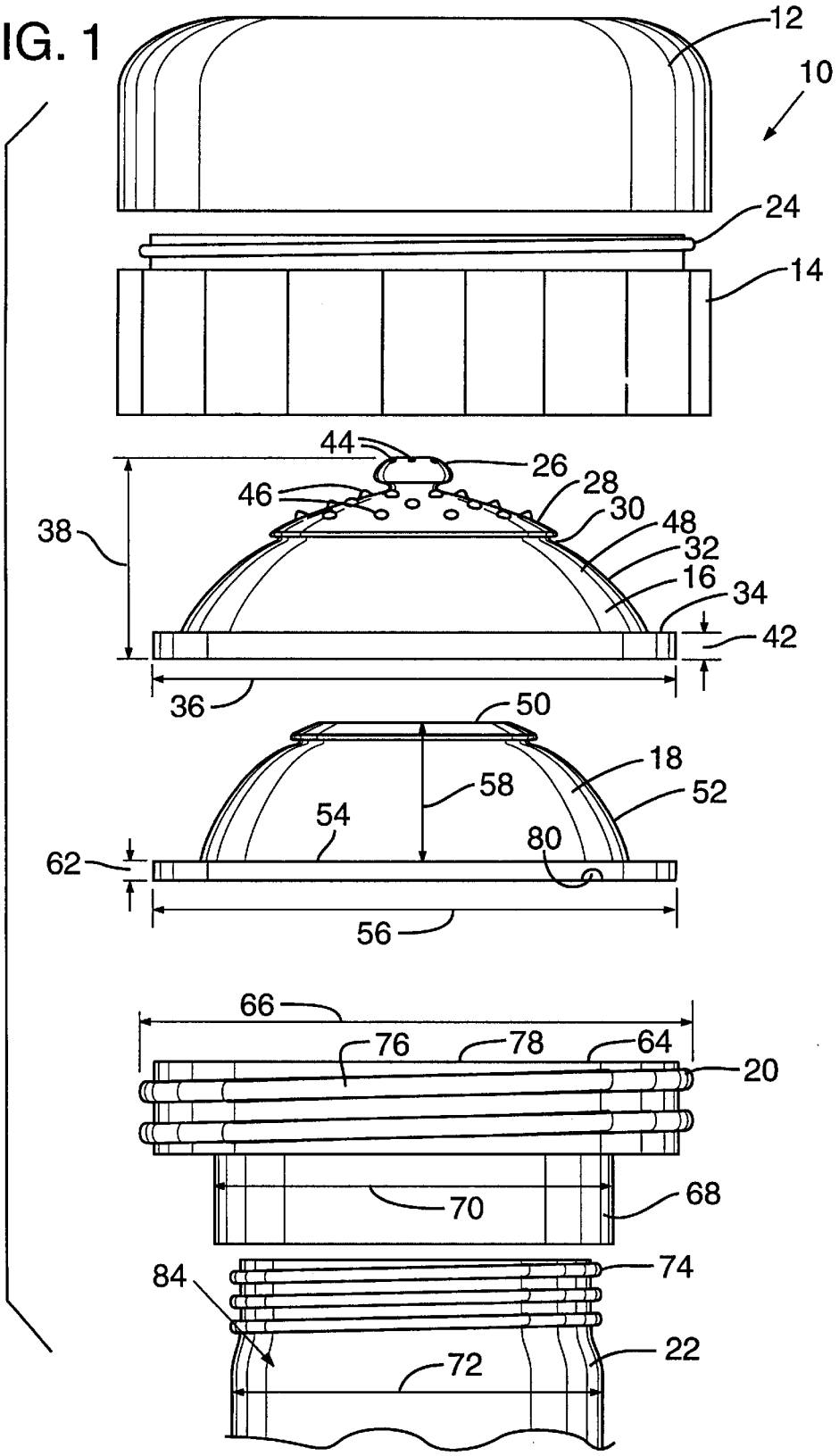
FIG. 1 is a side view of the nipple apparatus, including a cap and an adapter for attaching the nipple to a standard sized baby bottle.

Referring to FIG. 1, which is a side view of the nipple apparatus, including a cap and an adapter for attaching the nipple to a standard sized baby bottle, apparatus 10 comprises a cap 12, a collar 14, an outer membrane 16, an inner membrane 18, an adapter 20 and a standard sized baby bottle 22 which typically holds formula or breast milk (not shown). Cap 12 generally includes internal threads (not shown) that matingly engage external threads 24 on collar 14 so as to secure the cap in place. The cap thereby prevents damage to or desanitization of the membranes of the nipple apparatus during periods of nonuse. Collar 14 generally includes an aperture (not shown) which allows the membranes to extend upwardly there through so that the collar secures the membranes to the adapter along the edge regions of the membranes.

Outer membrane 16 includes a central nipple area 26, an outer nipple area 28, also called the areola, an expanding fold 30, an outer region 32, and an edge region 34. Outer membrane 16 preferably is manufactured of soft, pliant rubber material having a durometer, or a measure of softness, within a range of ten to sixty, and preferably approximately forty. Outer membrane 16 typically has a diameter 36 of approximately 3 inches (in) (7.6 centimeters (cm)), a height 38 of approximately 1.5 in (3.8 cm) and a thickness 40 (shown in FIG. 5) in outer nipple area 28 of approximately $1/16^{th}$ in (0.2 cm). The thickness and softness of the rubber material in outer nipple area 28 and in outer region 32 must allow for flexibility of the nipple apparatus during nursing, as will be described below. The thickness of the outer membrane increases toward edge region 34 such that edge region 34 typically has a thickness 42 of approximately $1/8^{th}$ in (0.3 cm) (shown in FIG. 5). The thickness of the edge region ensures that the edge region is durable enough to withstand compression between collar 14 and adapter 20 when the nipple apparatus is assembled and ensures that the outer membrane cannot easily be pulled from its secured position within the collar. Other materials and sizes may also be used as is appropriate. For example, the width of the outer membrane may be between two to five inches and the height may be between one and three inches. The height of the inner membrane would be manufactured to correspond to the outer membrane so as to facilitate correct "latching on" by the infant to the membranes, as will be described below.

Still referring to FIG. 1, central nipple area 26 of outer membrane 16 generally extends upwardly from outer nipple area 28 and includes a plurality of tiny apertures 44 which allow fluid to flow there through so as to simulate a natural breast nipple. Outer nipple area 28 generally includes a surface texture 46 on an outer surface 48 of the membrane so as to simulate a natural areola. In the preferred embodiment, the outer membrane is manufactured from a mold taken from an actual woman's breast. Accordingly, a unique feature of the nipple apparatus of the present invention are the varying textures of the central and outer nipple areas that correspond to an actual woman's breast which consists of both different shapes and varying textures of skin. In particular, the areola area consists of different levels and thicknesses of skin along with areas that are smooth and areas that are dimpled.

Still referring to FIG. 1, expanding fold 30 (which is an addition to an outer membrane that is manufactured from a mold of an actual woman's breast) allows the central nipple area to be stretched upwardly from outer region 32, as will be described below. As described above, in the preferred embodiment, the shape and outer surface texture of the outer membrane is taken from a mold of an actual nursing mother's breast. Moreover, the color of the rubber may be tinted so that the outer membrane looks familiar to a nursing infant. Accordingly, due to the wide diameter, color, texture, pliancy, stretchability and shape of the outer membrane, an infant will recognize and be comfortable with the nipple apparatus of the present invention.

Inner membrane 18 includes a plateau 50, also called a flattened area, an outer region 52 and an edge region 54. Outer region 52 and edge region 54 generally are the same shape as outer region 32 and edge region 34 of the outer membrane so that the two membranes easily fit together along their outer and edge regions when the membranes are secured to adapter 20 by collar 14. Similar to the outer membrane, inner membrane 18 preferably is manufactured of soft, pliant rubber material having a durometer, or a measure of softness, generally in the range of ten to sixty, and preferably approximately 40. Inner membrane 18 typically has a diameter 56 of approximately 3 inches (in) (7.6 centimeters (cm)), a height 58 of approximately 1.0 in (2.5 cm) and a thickness 60 (shown in FIG. 5) in outer region 52 of approximately $1/16^{th}$ in (0.2 cm). The thickness and softness of the rubber material in outer region 52 must allow for flexibility of the nipple apparatus during nursing as will be described below. Edge region 54 typically has a thickness 62 of approximately $1/8^{th}$ in (0.3 cm) (shown in FIG. 5) so that the edge region is durable enough to withstand compression between collar 14 and adapter 20 when the nipple apparatus is assembled and so that the inner membrane cannot easily be pulled from its secured position within the collar.

Still referring to FIG. 1, adapter 20 includes a top region 64 having a diameter 66 of approximately 3 inches (in) (7.6 centimeters (cm)) and a lower region 68 having a diameter 70 of approximately 1.5 inches (in) (3.8 centimeters (cm)). Diameter 70 of the lower region of the adapter is approximately the same size as a diameter 72 of a standard baby bottle 22 (which generally holds formula or breast milk) such that the internal threads (not shown) of the adapter are easily secured to external threads 74 of bottle 22. In other embodiments, other adapters may be provided which allow the baby feeding apparatus to be attached to other sized bottles such as a standard open bottle (wherein the fluid is contained within a fluid baggie held within the bottle) having a diameter of approximately 2.0 in (5.1 cm).

To assemble the nipple apparatus, collar 14 is positioned over outer membrane 16 and inner membrane 18 and is secured to adapter 20 by engaging the internal threads of the collar with external threads 76 of adapter 20. The collar is tightened on the adapter until the edge regions of the inner and outer membranes make an air tight seal with one another and with an upper edge 78 of the adapter. The adapter is then secured by its internal threads (not shown) to external threads 74 of bottle 22. In the preferred embodiment, inner membrane 18 includes an air vent 80 that allows air to flow into an interior 84 of bottle 22 when fluid is withdrawn under pressure through nipple 26, as will be described below, so that a build up of pressure in the bottle does not prevent the flow of fluid therefrom. Air vent 80 may comprise a one-way valve such that fluid cannot escape there through.

Figure 2:
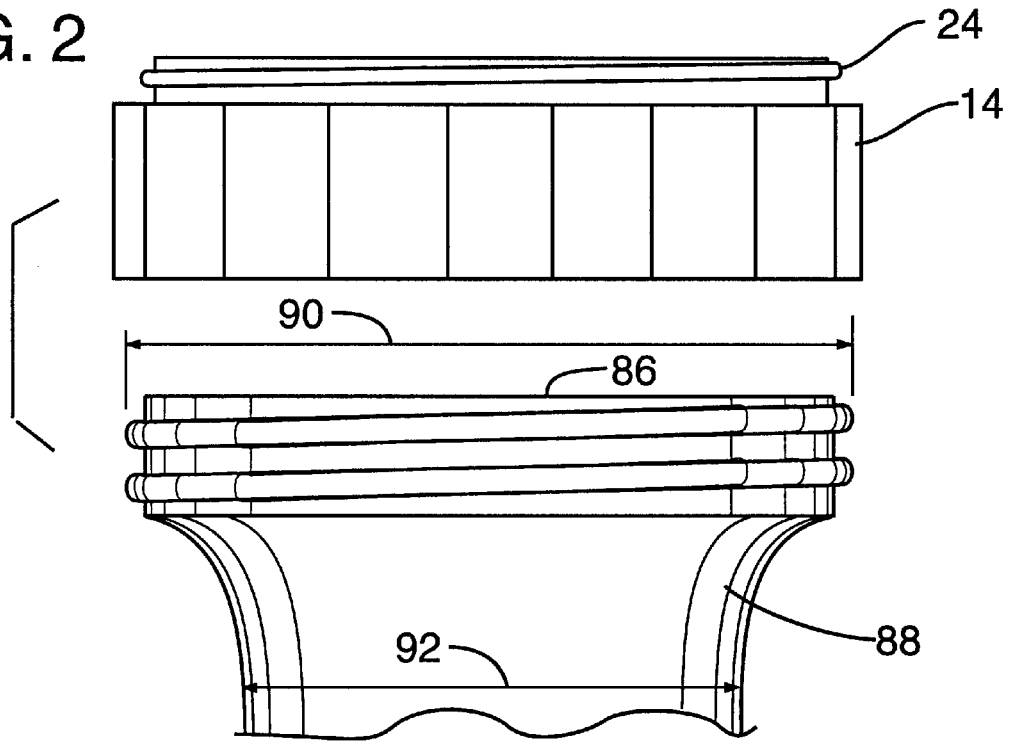
FIG. 2 is a side view of an attachment collar and a larger bottle sized for use with the nipple apparatus.

Referring to FIG. 2, which is a side view of an attachment collar and a larger bottle sized for use with the nipple apparatus, collar 14 is shown positioned above an upper edge 86 of a bottle 88 sized to accept the collar. Accordingly, upper edge 86 of bottle 88 has a diameter 90 of approximately 3 inches (in) (7.6 centimeters (cm)). The bottle may taper to a smaller diameter 92 of approximately 2 inches (in) (5.1 centimeters (cm)) so that the body of bottle 88 is approximately the same size as an open or disposable baby bottle unit. Accordingly, bottle 88 may be carried in standard baby bags, bottle holders, and the like, and may also be grasped with both hands by an infant using the bottle. Moreover, the nipple apparatus of the present invention allows several bottles choices for the consumer. In particular, due to the adapter, the nipple apparatus can be used on a disposable unit, a closed bottle unit, or also with the invented larger sized bottle specific to the larger size nipple of the present invention. Moreover, any size adapter may be provided as is required.

Figure 3:
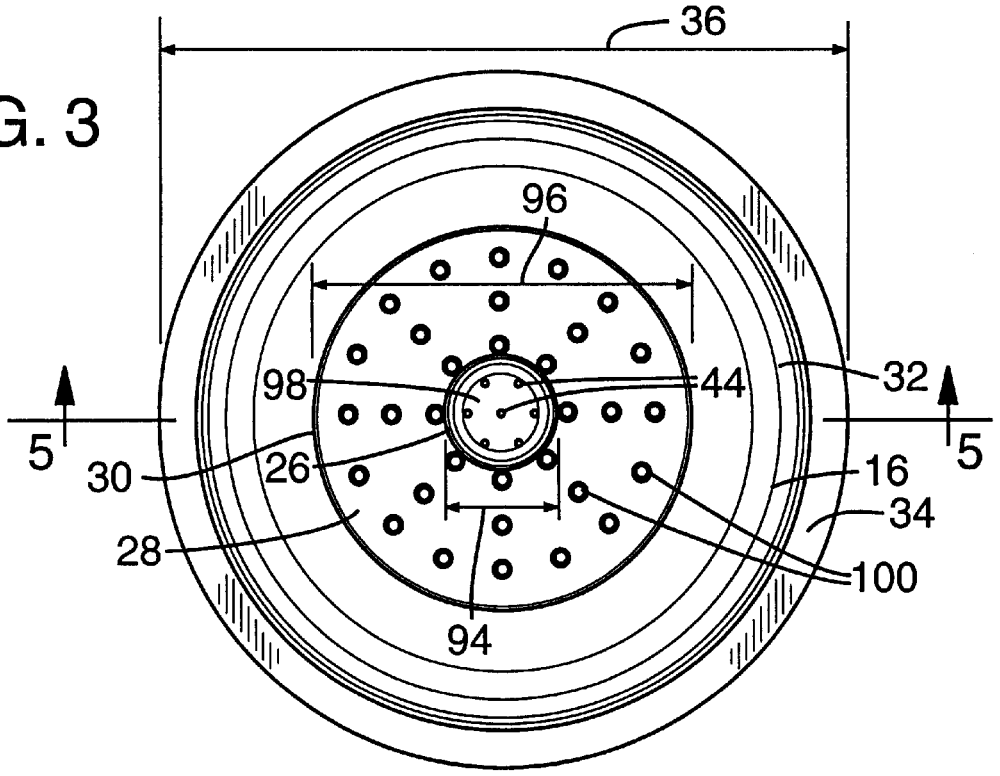
FIG. 3 is top view of the nipple apparatus without the cap or collar in place.

Referring to FIG. 3, which is top view of the nipple apparatus without the cap or collar in place, central nipple area 26 has a diameter 94 of approximately ½ in (1.3 cm) and outer nipple area 28 has a diameter 96 of approximately 2.0 in (5.1 cm). Apertures 44 are shown on an upper surface 98 of nipple 26 and textured protrusions 100 are shown on outer nipple area 28.

Figure 4:
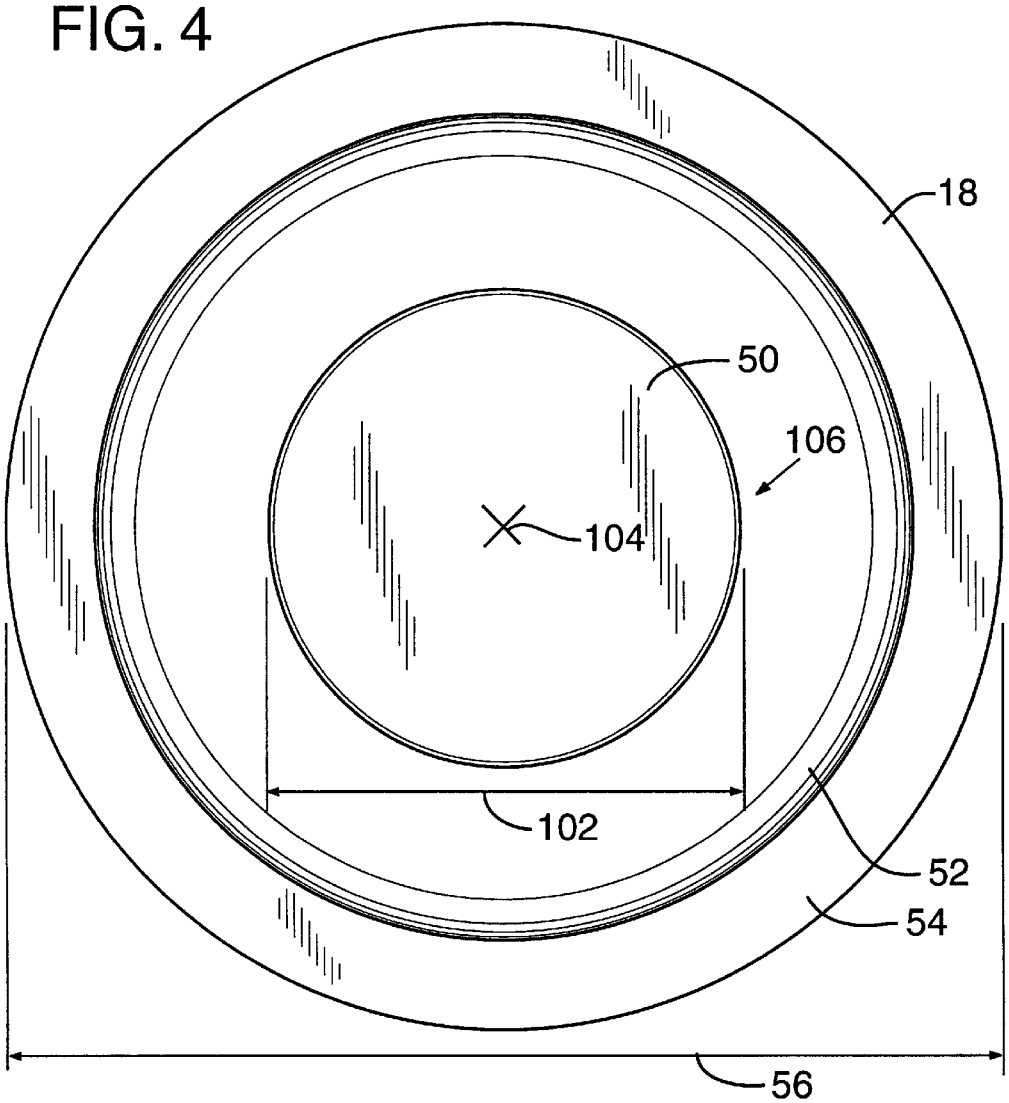
FIG. 4 is a top view of inner membrane of the nipple apparatus.

Referring to FIG. 4, which is a top view of inner membrane 18 of the nipple apparatus, plateau 50 has a diameter 102 of approximately 2.0 in (5.1 cm) and a valve 104 located generally centrally therein. Valve 104, in the preferred embodiment, comprises two slits which form an "X" shape and extend through the thickness of the inner membrane. Accordingly, when inner membrane 18 is compressed inwardly toward the valve, or when a relatively large pressure force is applied to the valve, the slits will give way thereby allowing fluid flow there through. In other embodiments, valve 104 may comprise a single slit, more than two slits, any one-way valve as known in the art, or the like.

Figure 5:
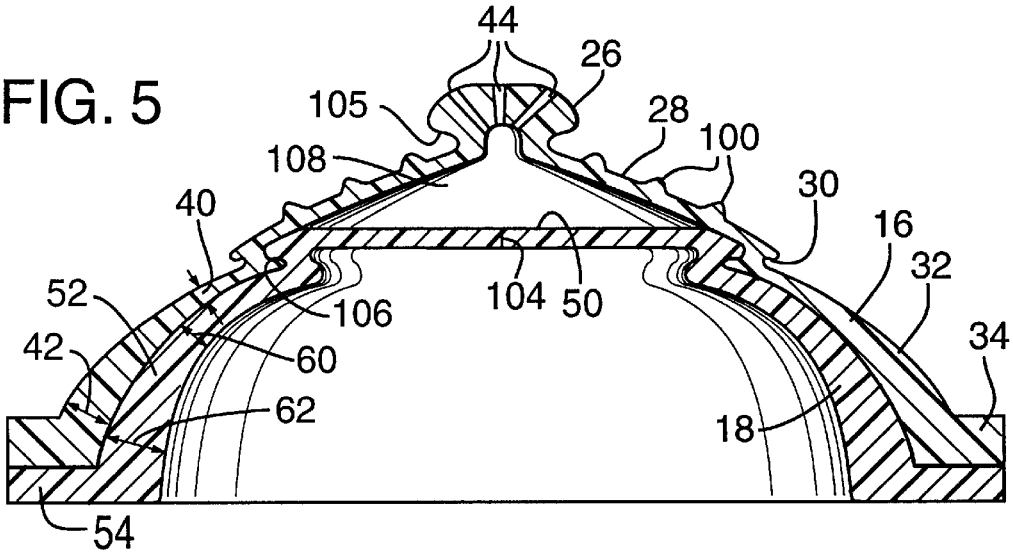
FIG. 5 is a cross sectional side view of the inner and outer membranes of the nipple apparatus in a nominal state taken along line 5—5 of FIG. 3.

Referring to FIG. 5, which is a cross sectional side view of the inner and outer membranes of the nipple apparatus in a nominal state taken along line 5—5 of FIG. 3, the thickness of outer region 32 of outer membrane 16 is shown to become thicker as the outer region approaches edge region 34. This increasing thickness of the outer membrane adds stability to the nipple apparatus while allowing great flexibility in outer nipple area 28. Expanding fold 30 comprises a recess positioned radially outwardly of outer nipple area 28 and radially inwardly of edge region 34. Central nipple area 26 includes an indentation 105 that allows the central nipple area to be stretched upwardly, as will be described below.

Inner membrane 18 includes a recess 106 around the edge of plateau 50, the recess generally corresponding in size to the recess that comprises expanding fold 30. Accordingly, inner membrane 18 "snaps" into place within outer membrane 16 such that expanding fold 30 is positioned within recess 106 of the inner membrane. In this assembled position, outer region 32 of outer membrane 16 is directly adjacent outer region 52 of inner membrane 18, and edge region 34 of outer membrane 16 is directly adjacent edge region 54 of inner membrane 18. In this position the membranes define a hollow chamber 108 between plateau 50 and outer nipple area 28 to which communicate apertures 44 in the nipple and valve 104 in the inner membrane. In the nominal, or relaxed state, valve 104 is in a closed or flat position such that fluid does not flow there through and expanding fold 30 and indentation 105 are in non-stretched and non-elongated positions.

Figure 6:
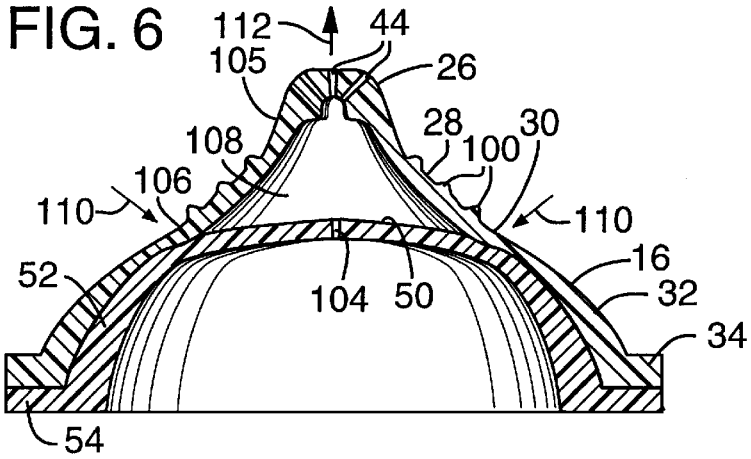
FIG. 6 is a cross sectional side view of the inner and outer membranes of the nipple apparatus of FIG. 5 in a pressurized state during use.

Referring to FIG. 6, which is a cross sectional side view of the inner and outer membranes of the nipple apparatus of FIG. 5 in a pressurized state during use, direct pressure is shown being applied to outer nipple area 28 of the outer membrane in a direction 110 which represents the pressure exerted uniformly around the outer nipple area by an infants mouth as the infant grasps the outer nipple area. This pressure acts to form a seal around the outer nipple area and the infant's mouth. Simultaneously, the infant applies suction and mechanical pressure to nipple 26 of the outer membrane in a direction 112 to stretch the central nipple area upwardly and away from the bottle. The inwardly applied pressure force exerted in a circular shape around outer nipple area 28 of the outer membrane and the upward stretching of the central nipple area results in stretching of the outer membrane into a taut position. The taut, stretched orientation of the outer membrane tends to inwardly compress outer region 52 of inner membrane 18 such that plateau 50 is pinched upwardly toward nipple 26, thereby opening valve 104.

With bottle 22 containing formula or breast milk positioned vertically above the nipple, the formula or breast milk will flow by the force of gravity through opened valve 104, into hollow chamber 108, and out through apertures 44. The suction pressure applied to nipple 26 further acts to pull the formula or breast milk from hollow chamber 108 through apertures 44. The thickness of the inner and outer membranes and the resiliency of valve 104 are chosen such that the suction pressure alone applied by the infant on nipple 26 will not result in opening of valve 104. The infant must correctly "latch on" to the nipple apparatus by applying pressure to outer nipple area 28, and by upwardly stretching the central nipple area, to enable fluid flow there through. In other words, an infant must take central nipple area 26 and outer nipple area 28 into its mouth and pull the nipple upwardly to receive nourishment, because merely grasping central nipple area 26 will not function to pinch or thereby open valve 104. Accordingly, the mechanical and suction pressure applied by the infant to central nipple area 26 of the nipple apparatus causes central nipple area 26 to stretch upwardly, made possible by the flattening of indentation 105, such that the nipple apparatus simulates the deformation of a natural nipple during natural breast-feeding.

Before use, the nipple apparatus may need to be "primed" by exerting pressure on the squeezable bottle to force fluid to flow through value 104 and into hollow chamber 108. This will displace air initially contained within chamber 108 such that the air is not ingested by the infant. It should be understood that the pressure applied to the squeezable bottle to "prime" the nipple apparatus is much greater than the suction pressure that can be exerted by a typical infant such that the apparatus requires correct "latching on" by the infant but allows priming of the apparatus by the person providing the bottle.

Figure 7:
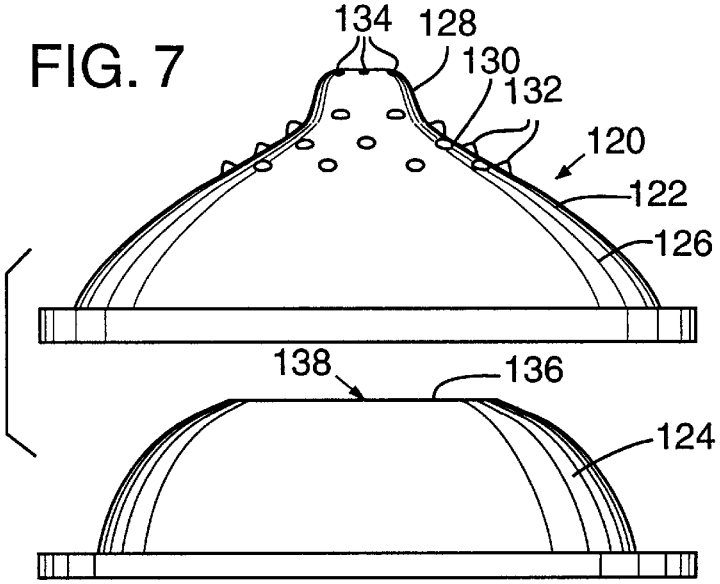
FIG. 7 is an exploded side view of the inner and outer membranes of a second embodiment of the nipple apparatus.

Referring to FIG. 7, which is an exploded side view of the inner and outer membranes of a second embodiment of the nipple apparatus, nipple apparatus 120 includes an outer membrane 122 and an inner membrane 124. Outer membrane 122 includes a smooth, rounded outer region 126 that does not include an expanding fold adjacent the outer nipple area or an indentation adjacent the central nipple area, and inner membrane 124 does not include a recess.

Without the presence of an expanding fold, when the inner and outer membranes are positioned adjacent one another in the assembled position on a bottle, the membranes do not "snap" together. Due to the mating shapes of the inner surface of the outer membrane and the outer surface of the inner membrane, however, the membranes form a seal with one another around their respective edge regions. During the application of pressure to the central nipple area it will stretch upwardly due to the flexibility of the rubber material but not due an indentation positioned around the central nipple area. Accordingly, this embodiment generally is manufactured of a rubber material somewhat softer and more flexible than the material used to manufacture the embodiment shown in the previous figures. In particular, nipple apparatus 120 is generally manufactured with a twenty five to thirty durometer silicone material, and preferably a durometer of approximately 30. The first embodiment, shown in FIG. 1, due to the inclusion of the expanding fold and the indentation, is particularly suited to be used with approximately a forty to fifty durometer silicone material. Accordingly, the present invention may be manufactured with indentations and folds using a high durometer material, or manufactured without indentations and folds using a lower durometer material. The second embodiment shown in FIG. 7 is generally manufactured from a mold of an actual nursing mother's breast and is not modified by the inclusion of the expanding fold or indentation.

Figure 8:
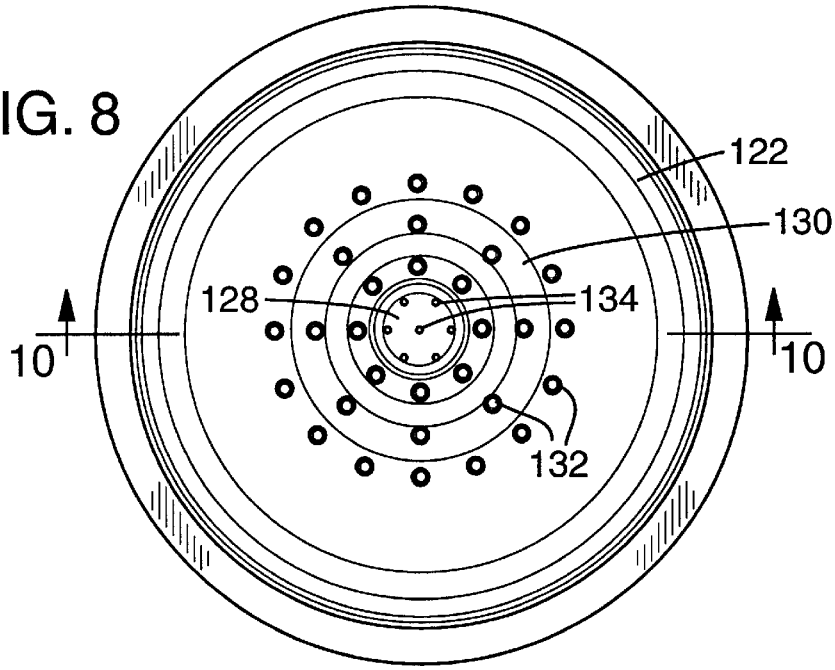
FIG. 8 is a top view of the outer membrane of the nipple apparatus of FIG. 7.

Referring to FIG. 8, which is a top view of the outer membrane of the nipple apparatus of FIG. 7, outer membrane 122 includes a central nipple area 128 and an outer nipple area 130 having similar texture 132 and apertures 134 as the nipple apparatus embodiment shown in FIG. 3.

Figure 9:
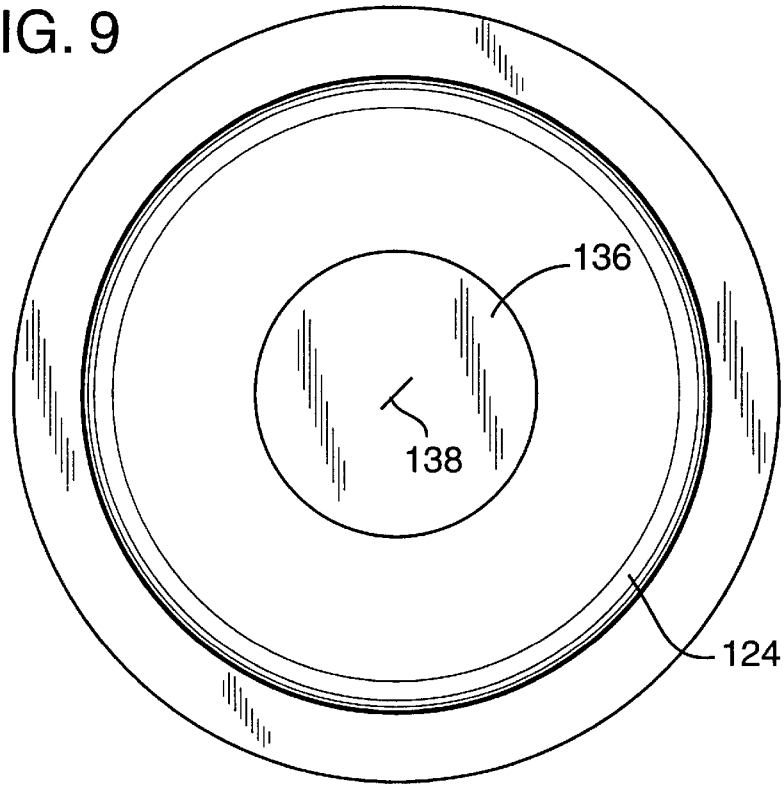
FIG. 9 is a top view of the inner membrane of the nipple apparatus of FIG. 7.

Referring to FIG. 9, which is a top view of the inner membrane of the nipple apparatus of FIG. 7, inner membrane 124 includes a plateau 136 and a valve 138, similar to the embodiment shown in FIG. 4.

Figure 10:
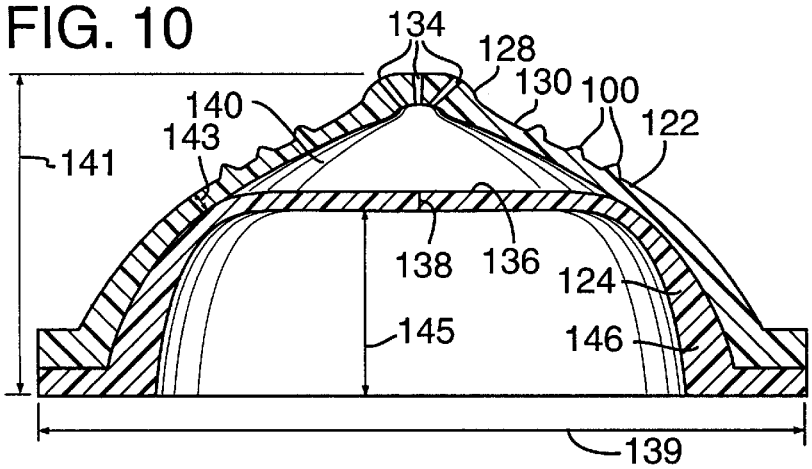
FIG. 10 is a cross sectional side view of the inner and outer membranes of the second embodiment of the nipple apparatus in a nominal state taken along line 10—10 of FIG. 8.

Referring to FIG. 10, which is a cross sectional side view of the inner and outer membranes of the second embodiment of the nipple apparatus in a nominal state taken along line 10—10 of FIG. 8, outer membrane 122 and plateau 136 on inner membrane 124 define a chamber 140 to which communicate apertures 134 in central nipple area 128 and valve 138 in inner membrane 124. Similar to the embodiment shown in FIG. 5, the outer membrane of nipple apparatus 120 has a width 139 of approximately 3 inches (in) (7.6 centimeters (cm)), a height 141 of approximately 1.5 in (3.8 cm) and a thickness 143 in outer nipple area 130 of approximately $1/16^{th}$ in (0.2 cm). Inner membrane 124 has a height 145 of approximately 1.0 in (2.5 cm).

Figure 11:
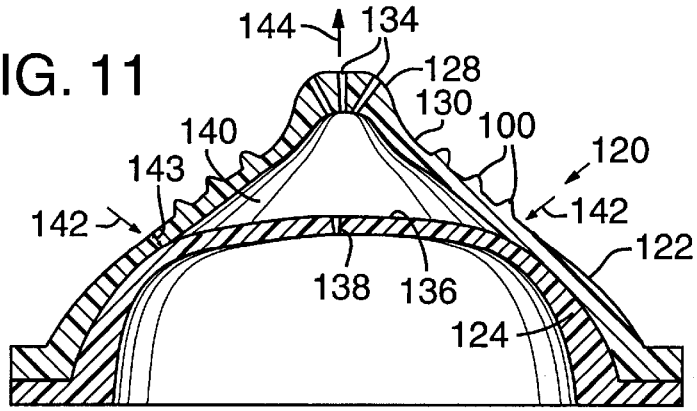
FIG. 11 is a cross sectional side view of the inner and outer membranes of the nipple apparatus of FIG. 10 in a pressurized state during use.

Referring to FIG. 11, which is a cross sectional side view of the inner and outer membranes of the nipple apparatus of FIG. 10 in a pressurized state during use, direct pressure is shown being applied to outer nipple area 130 of the outer membrane in a direction 142 which represents the pressure exerted uniformly around the outer nipple area by an infant's mouth. This pressure tends to ensure that a seal is made between the outer nipple area and the infant's mouth. Simultaneously, mechanical and suction pressure are applied to nipple 128 of the outer membrane in a direction 144 by the mouth of the infant. The pressure exerted in a circular shape around outer nipple area 130 of the outer membrane, and the upward pressure exerted on the central nipple area of apparatus, stretches the outer membrane upwardly and away from bottle 22 so that the outer membrane is taut. The stretched, taut orientation of the outer membrane pinches outer region 146 of inner membrane 124 such that plateau 136 is pinched upwardly toward nipple 128, thereby opening valve 138.

With a bottle containing fluid (such as formula, breast milk, juice or the like) positioned vertically above the nipple, the fluid will flow by the force of gravity through opened valve 138, into hollow chamber 140, and out through apertures 134. The suction pressure applied to nipple 128 further acts to pull fluid from hollow chamber 140 through apertures 134. The thickness of the inner and outer membranes and the resiliency of valve 138 are chosen such that the suction pressure alone applied by the infant on nipple 128 will not result in opening of valve 138. Accordingly, the infant must correctly "latch on" to the nipple apparatus to enable fluid flow there through. In other words, the infant must take central nipple area 128 and outer nipple area 130 into its mouth to receive nourishment because merely grasping central nipple area 128 will not function to pinch or thereby open valve 138. Moreover, the mechanical and suction pressure applied by the infant to central nipple area 128 of the nipple apparatus causes central nipple area 128 to stretch upwardly, made possible by the flexibility of the rubber material, such that the nipple apparatus simulates the deformation of a natural nipple during natural breast-feeding.

Before use, the nipple apparatus may need to be "primed" by exerting pressure on the squeezable bottle to force fluid to flow through value 138 and into hollow chamber 140. This will displace air initially contained within chamber 140 such that the air is not ingested by the infant. It should be understood that the pressure applied to the squeezable bottle to "prime" the nipple apparatus is much greater than the suction pressure that can be exerted by a typical infant such that the apparatus facilitates correct "latching on" by the infant but allows priming of the apparatus by the person providing the bottle.

Figure 12:
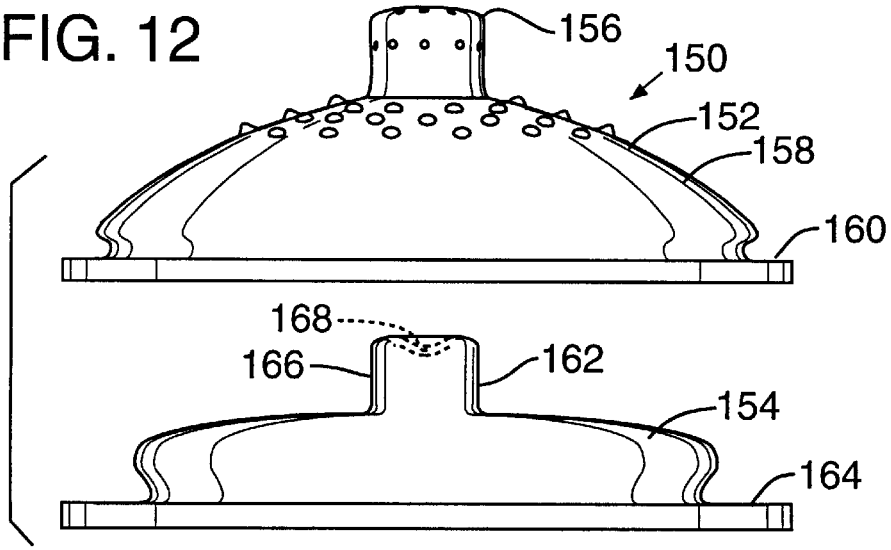
FIG. 12 is an exploded side view of the inner and outer membranes of a third embodiment of the nipple apparatus.

Referring to FIG. 12, which is an exploded side view of the inner and outer membranes of a third embodiment of the nipple apparatus, nipple apparatus 150 includes an outer membrane 152 and an inner membrane 154. Outer membrane 152 includes a central nipple area 156, an outer nipple area 158, and an edge region 160. Inner membrane 154 includes a valve region 162 and an edge region 164. Valve region 162 includes an upwardly extending projection 166 having a valve 168 therein. Valve 168 may comprise a one-way valve as known in the art or a slit or slits as shown in previous embodiments.

Figure 13:
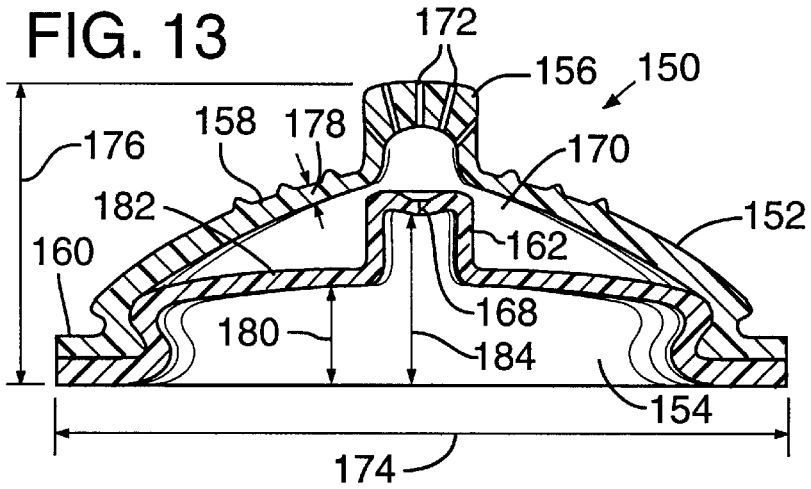
FIG. 13 is a cross sectional side view of the inner and outer membranes of the nipple apparatus of FIG. 12 in a nominal state.

Referring to FIG. 13, which is a cross sectional side view of the nipple apparatus of FIG. 12 in a nominal state, inner membrane 154 and outer membrane 152 define a hollow chamber 170 there between to which communicate apertures 172 in central nipple area 156, and valve 168. This embodiment has a double projection structure in that central nipple area 156 and valve region 162 both extend upwardly from a bottle positioned adjacent the inner membrane. Similar to the embodiment shown in FIG. 5, outer membrane 152 of nipple apparatus 150 has a width 174 of approximately 3 inches (in) (7.6 centimeters (cm)), a height 176 of approximately 1.5 in (3.8 cm) and a thickness 178 in outer nipple area 158 of approximately $1/16^{th}$ in (0.2 cm). The thickness increases to approximately $1/8^{th}$ in (0.3 cm) at edge region 160 so as to add stability to the nipple apparatus. The inner and outer membranes also include mating indentations in their edge region such that the membranes matingly engage one another when attached by a collar to a bottle or fluid container.

Inner membrane 154 has a height 180 of approximately 0.5 in (1.3 cm) measured at a plateau region 182 and a height 184 of approximately 0.9 in (2.4 cm) measured at valve region 162. Accordingly, if an infant grasps only central nipple area 156 in their mouth and applies a mechanical pressure force radially inwardly, then only the central nipple area will be compressed inwardly and will not contact upwardly extending valve region 162. The valve, therefore, will not be opened by the pressure force of the infants's mouth such that no fluid will flow from bottle 22 into hollow chamber 170. The double projection structure of this embodiment, therefore, facilitates correct "latching-on" of an infant using this nipple apparatus.

Figure 14:
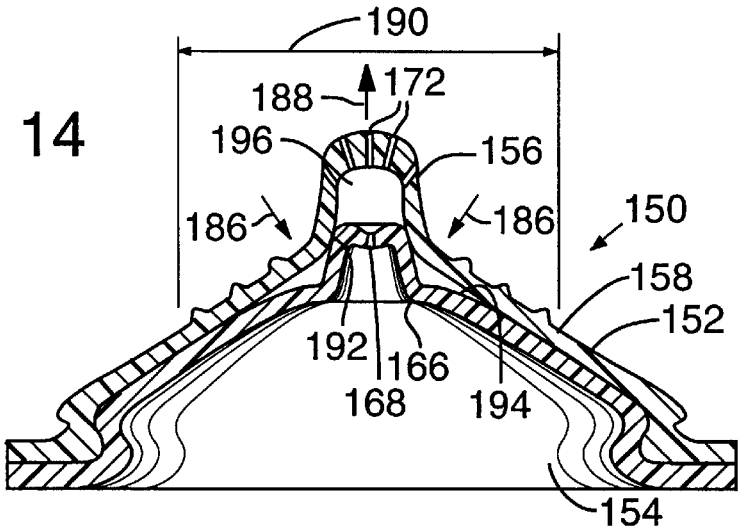
FIG. 14 is a cross sectional side view of the nipple apparatus of FIG. 13 in a pressurized state during use.

Referring to FIG. 14, which is a cross sectional side view of the nipple apparatus of FIG. 13 in a pressurized state during use, direct pressure is shown being applied to outer nipple area 158 of the outer membrane in a direction 186 which represents the pressure exerted uniformly around the outer nipple area by an infant's mouth. This pressure results in a uniform seal between the infant's mouth and the outer nipple area of the apparatus. At the same time, mechanical and suction pressure are applied to central nipple area 156 of the outer membrane in a direction 188 by the mouth of the infant. The pressure force exerted in a circular shape around outer nipple area 158 of the outer membrane, and the upward pressure exerted on the central nipple area, result in upward stretching of outer membrane 152. The taut outer membrane contacts inner membrane 154 such that upwardly extending projection 166, and valve 168 therein, are pinched radially upwardly and inwardly, thereby opening the valve. The pressure applied to outer nipple area 158 by the infant generally must form a circular ring of pressure having a diameter 190 of approximately 2.0 in (5.0 cm) in order for the outer membrane to correctly open the valve of the inner membrane. This size diameter is the same size as is required for correct "latching on" by the infant when breast-feeding naturally. Moreover, the amount of upward stretching of the central nipple area is the same amount of stretching as is required for correct "latching on" by the infant when breast-feeding naturally.

With a bottle containing breast milk positioned vertically above the nipple, the breast milk will flow by the force of gravity through opened valve 168, into hollow chamber 170, and out through apertures 172. The suction pressure applied to nipple 156 further acts to pull breast milk from hollow chamber 170 through apertures 172. The thickness of the inner and outer membranes and the resiliency of valve 168 are chosen such that the suction pressure alone applied by the infant on nipple 156 will not result in opening of valve 168. Accordingly, the infant must correctly "latch on" to the nipple apparatus to enable fluid flow there through. In other words, the infant must take generally the entire diameter of central nipple area 156 and outer nipple area 158 into its mouth, and must stretch the nipple upwardly, to receive nourishment because merely grasping central nipple area 156 will not function to pinch or thereby open valve 168. Accordingly, the suction pressure applied by the infant to outer nipple area 158 of the nipple apparatus causes central nipple area 156 to stretch upwardly, made possible by the flexibility of the rubber material, such that the nipple apparatus replicates the deformation and function of a natural nipple during natural breast-feeding.

In particular, when pressure is applied in direction 188, an inner corner area 192 of outer membrane 152 makes contact with upwardly extending projection 166. With this motion, the nominal shape of outer surface 194 of the inner membrane is altered wherein valve 168 is forced open thereby allowing fluid to enter the hollow chamber and then exit apertures 172 in the outer membrane. Upwardly extending projection 166, when engaged by inner corner area 192 of the taut, stretched outer membrane, forms a smaller hollow chamber 196 with the outer membrane than chamber 170, which facilitates a more direct route of fluid out of the nipple apparatus. Accordingly, this embodiment may not need priming or may require less priming than the embodiments previously described.

Figure 15:
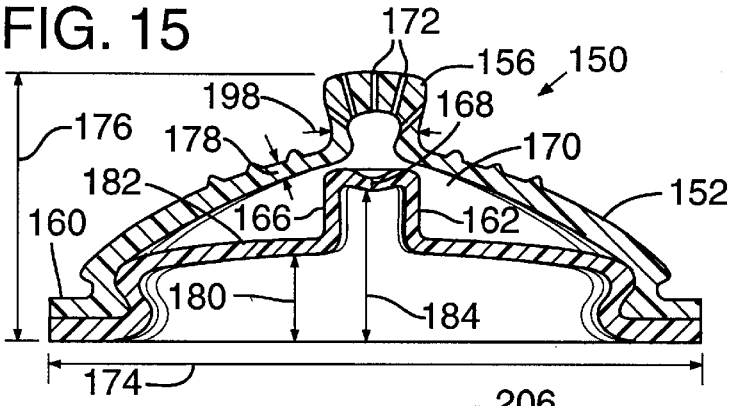
FIG. 15 is a cross sectional side view of the nipple apparatus of FIG. 13 in an incorrect "latched-on" position such that the inner membrane is not contacted by the outer membrane in the central nipple region.

Referring to FIG. 15, which is a cross sectional side view of the nipple apparatus of FIG. 13 in an incorrect "latched-on" position such that the inner membrane is not contacted by the outer membrane in the central nipple region, mechanical pressure is shown applied in a direction 198 to central nipple area 156, and no upward mechanical or suction pressure is applied to the outer membrane to stretch the membrane upwardly, such that the tip of the nipple is pinched radially inwardly, above the upwardly extending projection of the inner membrane. In particular, pinching of the central nipple area does not facilitate contact of an inner surface of the outer membrane with upwardly extending projection 166 of the inner membrane such that valve 168 is not opened. Accordingly, even if suction pressure and mechanical pressure are simultaneously applied by the infant to central nipple area 156, the outer membrane is not stretched upwardly, valve 168 is not moved to an open position, and fluid will not flow from a bottle secured to the inner membrane. The nipple apparatus of the present invention, therefore, requires an infant to correctly "latch on" by taking the entire central nipple area into their mouth, and stretching upwardly the outer membrane, to facilitate fluid flow through the device.

Figure 16:
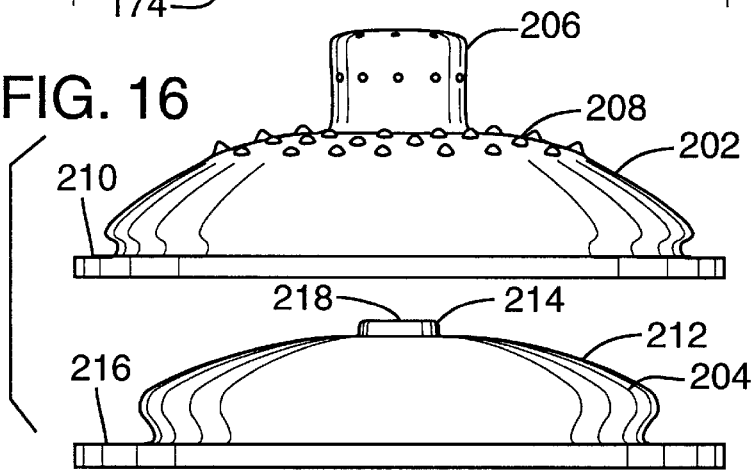
FIG. 16 is an exploded side view of the inner and outer membranes of a fourth embodiment of the nipple apparatus.

Referring to FIG. 16, which is an exploded side view of the inner and outer membranes of a fourth embodiment of the nipple apparatus, nipple apparatus 200 includes an outer membrane 202 and an inner membrane 204. Outer membrane 202 includes a central nipple area 206, an outer nipple area 208, and an edge region 210. Inner membrane 204 includes a tapered region 212, a valve region 214 and an edge region 216. Valve region 214 includes a valve 218 that may comprise a one-way valve, a slit or slits, or any like device, as known in the art.

Figure 17:
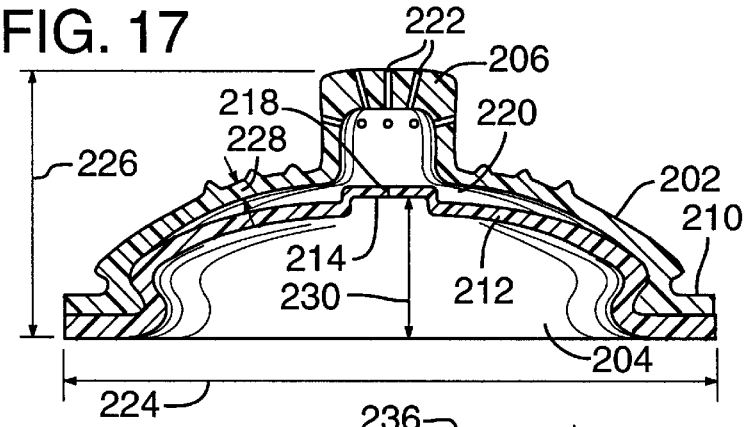
FIG. 17 is a cross sectional side view of the inner and outer membranes of the nipple apparatus of FIG. 16 in a nominal state.

Referring to FIG. 17, which is a cross sectional side view of the inner and outer membranes of the nipple apparatus of FIG. 16 in a nominal state, inner membrane 204 and outer membrane 202 define a hollow chamber 220 there between to which communicate apertures 222 in central nipple area 206, and valve 218. This embodiment has what may be described as a double projection structure in that central nipple area 206 and valve 218 both extend upwardly from a bottle 22. Similar to the embodiment shown in FIG. 13, outer membrane 202 of nipple apparatus 200 has a width 224 of approximately 3 inches (in) (7.6 centimeters (cm)), a height 226 of approximately 1.5 in (3.8 cm) and a thickness 228 in outer nipple area 208 of approximately $1/16^{th}$ in (0.2 cm). The thickness increases to approximately $1/8^{th}$ in (0.3 cm) at edge region 210 so as to add stability to the nipple apparatus. The inner and outer membranes also include mating indentations in their edge region such that the membranes mating engage one another when attached by a collar to a bottle or fluid container.

Inner membrane 204 has a height 230 of approximately 1.0 in (2.5 cm) measured at valve region 214. Accordingly, if an infant grasps only central nipple area 206 in their mouth and applies a pressure force radially inwardly, then only the central nipple area will be compressed inwardly and will not contact tapered region 212 or valve region 214. The valve, therefore, will not be opened by the pressure force of the infant's mouth such that no fluid will flow from bottle 22 into hollow chamber 220. The double projection structure of this embodiment, therefore, facilitates correct "latching-on" of an infant using this nipple apparatus.

Figure 18:
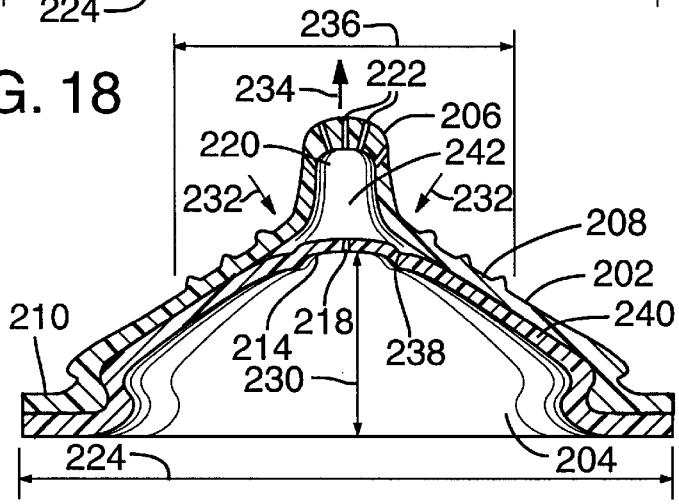
FIG. 18 is a cross sectional side view of the nipple apparatus of FIG. 17 in a pressurized state during use.

Referring to FIG. 18, which is a cross sectional side view of the nipple apparatus of FIG. 17 in a pressurized state during use, direct pressure is shown being applied to outer nipple area 208 of the outer membrane in a direction 232 which represents the pressure exerted uniformly around the outer nipple area by an infant's mouth. This pressure results in a seal being formed between the infant's mouth and the outer nipple area of the outer membrane. Simultaneously, mechanical and suction pressure are applied to central nipple area 206 of the outer membrane in a direction 234 by the mouth of the infant. The pressure force exerted in a circular shape around outer nipple area 208 of the outer membrane, and the upward stretching of the outer membrane results in a taut, or stretched, orientation of the outer membrane such that tapered region 212 and valve 218 of inner membrane 204 are pinched radially inwardly and upwardly toward nipple 206, thereby opening the valve. The pressure applied to outer nipple area 208 by the infant generally must form a circular ring of pressure having a diameter 236 of approximately 2.0 in (5.0 cm), and the central nipple area must be stretched upwardly, in order for the outer nipple area of the outer membrane to correctly contact the inner membrane to open the valve. This size diameter is approximately the same diameter that is required for correct "latching-on" by the infant when breast-feeding naturally. Moreover, the amount of stretching required of the outer membrane is approximately the same amount of stretching that is required for correct "latching on" by the infant when breast-feeding naturally.

With a bottle containing formula positioned vertically above the nipple, the formula will flow by the force of gravity through opened valve 218, into hollow chamber 220, and out through apertures 222. The suction pressure applied to nipple 206 further acts to pull formula from hollow chamber 220 through apertures 222. The thickness of the inner and outer membranes and the resiliency of valve 218 are chosen such that the suction pressure applied by the infant on nipple 206 will not result in opening of valve 218. Accordingly, the infant must correctly "latch on" to the nipple apparatus to enable fluid flow there through. In other words, an infant generally must take the entire diameter of central nipple area 206 and outer nipple area 208 into its mouth, and must stretch the outer membrane upwardly, to receive nourishment because merely grasping central nipple area 206 will not function to pinch or thereby open valve 218. In particular, the suction pressure applied by the infant to outer nipple area 208 of the nipple apparatus causes central nipple area 206 to stretch upwardly, made possible by the flexibility of the rubber material, such that the nipple apparatus replicates the deformation of a natural nipple during natural breast-feeding.

Stated differently, when pressure is applied in direction 232, and when the outer membrane is stretched upwardly so that it is taut, an inner corner area 238 of outer membrane 202 makes contact with tapered region 212. With this motion, the outer surface 240 of the tapered region is altered wherein valve 218 is forced open thereby allowing fluid to enter the hollow chamber and then exit apertures 222 in the outer membrane. Tapered region 212, when engaged by inner corner area 238 of the outer membrane, forms a small hollow chamber 242 with the outer membrane which facilitates a direct route of fluid out of the nipple apparatus. Accordingly, this embodiment may not need priming or may require less priming than the embodiments first described. Moreover, as stated earlier, the dual membrane system of the present invention facilitates sanitary cleaning of the device such that formula, juice, breast milk or the like does not collect or dry in the hollow chamber area between the membranes.

Figure 19:
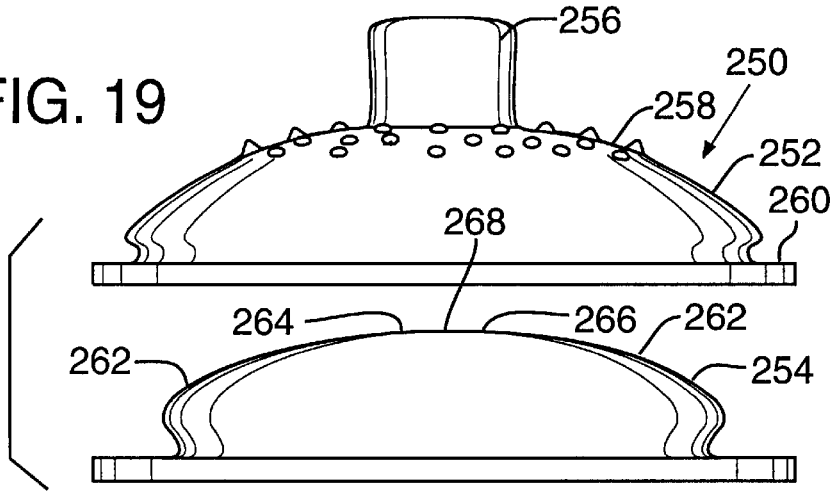
FIG. 19 is an exploded side view of the inner and outer membranes of a fifth embodiment of the nipple apparatus.

Referring to FIG. 19, which is an exploded side view of the inner and outer membranes of a fifth embodiment of the nipple apparatus, nipple apparatus 250 includes an outer membrane 252 and an inner membrane 254. Outer membrane 252 includes a central nipple area 256, an outer nipple area 258, and an edge region 260. Inner membrane 254 includes a tapered region 262, a plateau 264 and a generally flat valve region 266. Valve region 266 includes a valve 268 that may comprise a one-way valve as known in the art, or a slit or slits as shown in previously described embodiments.

Figure 20:
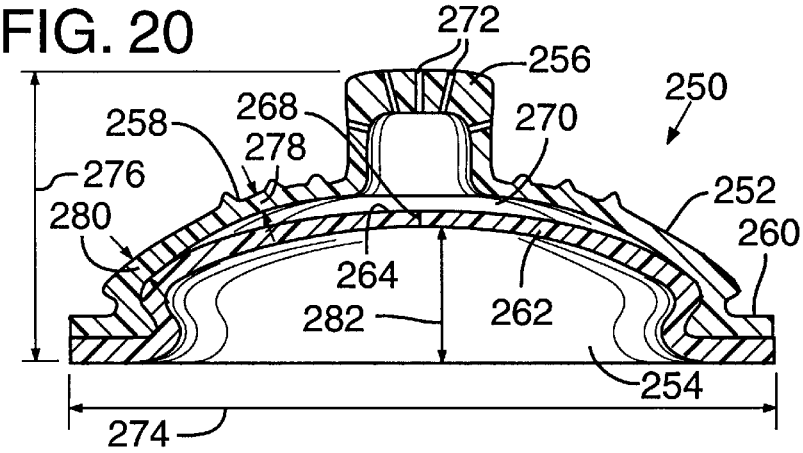
FIG. 20 is a cross sectional side view of the inner and outer membranes of the nipple apparatus of FIG. 19 in a nominal state.

Referring to FIG. 20, which is a cross sectional side view of the inner and outer membranes of the nipple apparatus of FIG. 19 in a nominal state, inner membrane 254 and outer membrane 252 define a hollow chamber 270 there between to which communicate apertures 272 in central nipple area 256, and valve 268. Similar to the embodiment shown in FIG. 16, outer membrane 252 of nipple apparatus 250 has a width 274 of approximately 3 inches (in) (7.6 centimeters (cm)), a height 276 of approximately 1.5 in (3.8 cm) and a thickness 278 in outer nipple area 258 of approximately $1/16^{th}$ in (0.2 cm). The thickness 280 is approximately $1/8^{th}$ in (0.3 cm) at edge region 260 so as to add stability to the nipple apparatus. The inner and outer membranes also include mating indentations in their edge region such that the membranes mating engage one another when attached by a collar to a bottle or fluid container.

Inner membrane 254 has a height 282 of approximately 1.0 in (2.5 cm) measured at valve region 266. Accordingly, if an infant grasps only central nipple area 256 in their mouth and applies a pressure force, then only the central nipple area will be compressed inwardly and will not contact tapered region 262 or plateau 264. The valve, therefore, will not be opened by the pressure force of the infant's mouth and no fluid will flow from bottle 22 into hollow chamber 270. The double membrane structure of this embodiment, therefore, facilitates correct "latching-on" of an infant using this nipple apparatus.

Figure 21:
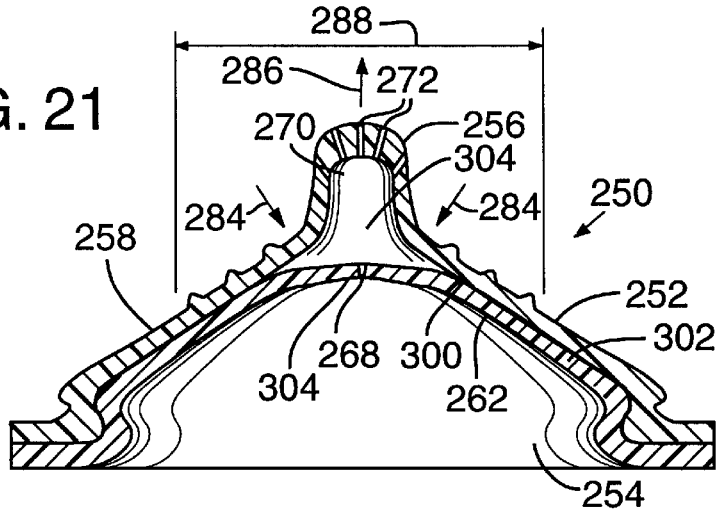
FIG. 21 is a cross sectional side view of the nipple apparatus of FIG. 20 in a pressurized state during use.

Referring to FIG. 21, which is a cross sectional side view of the nipple apparatus of FIG. 20 in a pressurized state during use, direct pressure is shown being applied to outer nipple area 258 of the outer membrane in a direction 284 which represents the pressure exerted uniformly around the outer nipple area by an infant's mouth. This pressure facilitates a seal of the outer membrane with the infant's mouth around the outer nipple area. Simultaneously, mechanical and suction pressure are applied to central nipple area 256 of the outer membrane in a direction 286 by the mouth of the infant so that the outer membrane is stretched upwardly away from bottle 22. The inwardly applied pressure force exerted in a circular shape around outer nipple area 258 of the outer membrane and the upward stretching of the outer membrane results in outer membrane 256 contacting tapered region 262 of inner membrane 254 such that valve 268 is pinched radially inwardly and upwardly toward nipple 206, thereby opening the valve. The pressure applied to outer nipple area 258 by the infant generally must form a circular ring of pressure having a diameter 288 of approximately 2.0 in (5.0 cm) in order for the outer nipple area of the outer membrane to correctly open the valve of the inner membrane. This size diameter is approximately the same diameter that is required for correct "latching-on" by the infant when breast-feeding naturally. Moreover, the infant must correctly stretch the outer membrane upwardly and away from the bottle for correct "latching on" to the nipple apparatus, which is the same technique that is required when the infant is breast-feeding naturally.

With a bottle containing formula positioned vertically above the nipple, the formula will flow by the force of gravity through opened valve 268, into hollow chamber 270, and out through apertures 272. The suction pressure applied to nipple 256 further acts to pull formula from hollow chamber 270 through apertures 272. The thickness of the inner and outer membranes and the resiliency of valve 268 are chosen such that the suction pressure applied by the infant to nipple 256 will not result in opening of valve 268. Accordingly, the infant must correctly "latch on" to the nipple apparatus to enable fluid flow there through. In other words, the infant must take generally the entire diameter of central nipple area 256 and outer nipple area 258 into its mouth, and must stretch the outer membrane upwardly, to receive nourishment because merely grasping central nipple area 256 will not function to pinch or thereby open valve 268. Accordingly, the suction pressure applied by the infant to outer nipple area 258 of the nipple apparatus causes central nipple area 256 to stretch upwardly, made possible by the flexibility of the rubber material, such that the nipple apparatus replicates the deformation of a natural nipple during natural breast-feeding.

In particular, when pressure is applied in direction 284, an inner corner area 300 of outer membrane 252 makes contact with tapered region 262. With this motion, the generally flat outer surface 302 of the tapered region is altered wherein valve 268 is forced open thereby allowing fluid to enter the hollow chamber and then exit apertures 272 in the outer membrane. Tapered region 262, when engaged by inner corner area 300 of the outer membrane, forms a small hollow chamber 304 with the outer membrane which facilitates a direct route of fluid out of the nipple apparatus. Accordingly, this embodiment may not need priming or may require less priming than the embodiments first described and also tends to lessen the amount of air in the chamber that might be swallowed by an infant, thereby lessening the chance of colic of the infant. Moreover, as stated earlier, the dual membrane system of the present invention facilitates sanitary cleaning of the device.

Accordingly, the valve of the inner membrane will open when correct mechanical movement and suction pressure are applied to the outer and inner membranes in unison. The valve will not open by mechanical movement or suction pressure alone, or by mechanical movement or suction pressure applied incorrectly to the nipple apparatus. The nipple apparatus of the present invention, therefore, will be a type of "training tool" when the infant is using the device. The infant must open their mouth and "latch-on" in the same way as with a natural mother's breast. Only when the infant "latches on" correctly will feeding occur. In this manner, the infant is required to use the same motion and amount of work as when naturally breast-feeding so that the infant will not prefer one method as opposed to the other.

Use of this apparatus makes it possible for the mother to receive a break from breast-feeding without causing nipple confusion by the infant. Specifically, the apparatus of the present invention facilitates a smooth transition to and from breast-feeding and bottle feeding thereby lessening the possibility that a child may choose breast-feeding or bottle feeding exclusively. This ease of transition to and from breast-feeding and bottle feeding may allow the nursing mother to breast-feed her infant for an extended period of time, for example, for the first year of the infant's life. As stated above, this long period of breast-feeding has many benefits for the infant's future and present health status.

While preferred embodiments of the present invention have been shown and described, it will be apparent to those skilled in the art that many changes and modifications may be made without departing from the invention in its broader aspects. The appended claims are intended to cover, therefore, all such changes and modifications as fall within the true spirit and scope of the invention.

I claim:

1. A natural nipple baby feeding apparatus comprising:

a container for holding fluid therein and including an open neck for the passage of fluid therethrough;

a flexible first membrane secured to said neck of said container along an outer edge of said first membrane, said first membrane including an outer surface, an inner surface, a central nipple region centrally positioned with respect to said outer edge and having in said central nipple region at least one aperture which allows the passage of fluid though said first membrane upon suction pressure being applied to said central nipple region, and an outer nipple region extending radially outwardly from said central nipple region to a distance approximately halfway between said central nipple region and said outer edge of said first membrane, and wherein said central nipple region comprises a projection that extends upwardly from said outer nipple region; and a flexible second membrane including an outer edge and being secured between said container and said first membrane such that said outer edge of the second membrane is contiguous with said outer edge of the first membrane, said second membrane further including an outer surface, an inner surface, a central valve region positioned centrally with respect to said outer edge of the second membrane and including a valve positioned therein, said central valve region being aligned with said central nipple region and comprising a projection which extends upwardly from a remainder of said second membrane, wherein said valve is in a closed position when said inner surface of said first membrane in said outer nipple region is spaced apart from said outer surface of said second membrane in said central valve region, and wherein said valve is moved to an open position so as to allow fluid flow therethrough when said inner surface of said first membrane in said outer nipple region is compressed inwardly against and compresses said outer surface of said second membrane completely around said central valve region.

2. The apparatus of claim 1 wherein said first membrane defines a height and a width, wherein said width is greater than said height, and wherein said outer nipple region defines an angle of approximately thirty degrees with respect to a plane defined by said outer edge of said first membrane.

3. The apparatus of claim 1 wherein said central nipple region of the first membrane is positioned upwardly from said central valve region of the second membrane such that when said central nipple region is pinched inwardly in a direction parallel to a plane defined by said outer edge of said first membrane then said central valve region is uncompressed and said valve remains in the closed position.

4. The apparatus of claim 1 wherein said outer nipple region is generally aligned with a top surface of said central valve region in a plane parallel to a plane defined by said outer edge of the first membrane such that when said outer nipple region is compressed inwardly in a direction toward said central valve region then said central valve region is compressed and said valve is moved to the open position.

5. The apparatus of claim 1 wherein said central nipple region has a diameter, said central valve region has a diameter, and wherein said diameter of said central nipple region is approximately the same as the diameter of said central valve region, and wherein said diameter of said central nipple region is less than one half a diameter of said outer edge of said first membrane.

6. The apparatus of claim 1 wherein said outer nipple region includes texture which simulates the texture of a natural areola and wherein said second membrane includes a plateau region positioned generally parallel to a plane defined by said outer edge of said second membrane.

7. A double membrane nipple apparatus comprising:

a flexible inner membrane including an edge and an upwardly extending valve region having a valve which is movable from a closed position to an open position wherein said valve allows fluid flow therethrough; and a flexible outer membrane releasably securable to said inner membrane, said outer membrane including an edge which contacts and is aligned with said edge of said inner membrane when said outer membrane is releasably secured to said inner membrane, said outer membrane having an upwardly extending nipple region including an aperture which allows fluid flow therethrough upon a suction pressure being applied to said upwardly extending nipple region, and said outer membrane including an outer nipple region surrounding said upwardly extending nipple region and extending outwardly from said upwardly extending nipple region toward but spaced from said edge of said outer membrane, wherein said valve moves from said closed position to said open position upon compression of said outer nipple region of the outer membrane into contact against and radially around said upwardly extending valve region of said inner membrane.

8. The apparatus of claim 7 wherein said central nipple region is positioned vertically upwardly of and nominally spaced apart from said central valve region, and wherein said valve remains in the closed position when said central nipple region is pinched radially inwardly such that said central nipple region remains spaced apart from said central valve region.

9. The apparatus of claim 7 wherein said valve is chosen from the group consisting of a slit, multiple slits, and a one-way valve, and wherein said outer nipple region extends radially approximately half way from a center of said outer membrane toward said edge of said outer membrane.

10. The apparatus of claim 7 wherein when said outer nipple region is compressed inwardly against and completely around and in contact with said upwardly extending valve region, said valve is moved to an open position and a hollow chamber is formed between said central nipple region and said central valve region so as to facilitate a straight fluid flow path through said valve, into said hollow chamber and out through said aperture in said central nipple region.

11. A method of receiving fluid through a nipple apparatus, comprising the steps of:

providing a nipple apparatus including a flexible outer sheath releasably secured to and spaced apart from a flexible inner sheath wherein an edge of said inner sheath is aligned with an edge of said outer sheath such that said sheaths contact one another nominally exclusively at said edges, said outer sheath including an upwardly extending nipple projection having an aperture extending therethrough and an areola area surrounding said upwardly extending nipple projection, said inner sheath including an upwardly extending valve projection aligned with said nipple projection and having a valve therein;

compressing said areola area of said outer sheath inwardly so as to surroundingly engage said valve projection of said inner sheath to move said valve from a closed position to an open position thereby allowing a fluid flow through said valve into a hollow chamber between said inner sheath and said outer sheath; and simultaneous to compressing said areola area, exerting suction pressure on said nipple projection of said outer membrane so as to pull said nipple projection upwardly from a nominal position of said outer sheath, thereby allowing a fluid flow from said hollow chamber through said aperture in said nipple projection.

12. The method of claim 11 wherein said step of compressing said areola area comprises grasping said areola area uniformly and circularly in one's mouth so as to form a seal between one's mouth and said areola area of said nipple apparatus wherein said areola area of said outer sheath is spaced from said edge of the outer sheath.

13. The method of claim 11 wherein said step of exerting suction pressure comprises sucking said nipple projection between one's tongue and one's palate.

* * * * *